US010056214B2

(12) United States Patent
Turner

(10) Patent No.: US 10,056,214 B2
(45) Date of Patent: Aug. 21, 2018

(54) HEATER APPARATUS, CIRCUIT INTERRUPTER, AND RELATED METHOD

(71) Applicant: EATON CORPORATION, Cleveland, OH (US)

(72) Inventor: David C. Turner, Imperial, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/155,191

(22) Filed: May 16, 2016

(65) Prior Publication Data

US 2016/0260567 A1 Sep. 8, 2016

Related U.S. Application Data

(62) Division of application No. 13/764,972, filed on Feb. 12, 2013, now Pat. No. 9,378,916.

(51) Int. Cl.

| | |
|---|---|
| ***H01H 69/00*** | (2006.01) |
| ***H01H 71/16*** | (2006.01) |
| ***H01H 71/08*** | (2006.01) |
| ***H01H 37/52*** | (2006.01) |
| ***H01H 11/00*** | (2006.01) |

(52) U.S. Cl.

CPC ..... *H01H 69/00* (2013.01); *H01H 11/00* (2013.01); *H01H 37/52* (2013.01); *H01H 71/08* (2013.01); *H01H 71/164* (2013.01); *Y10T 29/49083* (2015.01); *Y10T 29/49105* (2015.01)

(58) Field of Classification Search

CPC ..... H01H 71/164; H01H 71/08; H01H 69/00; H01H 37/52; H01H 11/00; Y10T 29/49083; Y10T 29/49105

USPC ..... 337/102, 107; 219/538, 541; 335/35, 335/43; 439/810–812

See application file for complete search history.

(56) References Cited

U.S. PATENT DOCUMENTS

| | | | | |
|---|---|---|---|---|
| 5,432,491 A * | 7/1995 | Peter | H01H 71/16 | 335/23 |
| 6,181,226 B1 * | 1/2001 | Leone | H01H 71/2454 | 335/132 |
| 7,518,482 B2 * | 4/2009 | Fleege | H01H 71/16 | 337/36 |
| 8,026,785 B2 * | 9/2011 | Tetik | H01H 71/16 | 337/111 |
| 8,115,129 B2 * | 2/2012 | Tetik | H01H 71/2454 | 200/400 |

* cited by examiner

*Primary Examiner* — Anatoly Vortman
(74) *Attorney, Agent, or Firm* — Eckert Seamans

(57) ABSTRACT

A heater apparatus is structured for use in a circuit interrupter having a thermal trip and includes a conductive device having a terminal and a heater that are co-formed with one another. The terminal includes a base and a support. The conductive device is formed from an individual metallic plate that is bent to form a number of plate elements. The base includes at least one plate element, and the heater includes at least another plate element, with the base and the heater being co-formed. A compression element is threadably receivable on the terminal and is structured to compressively retain an electrical conductor between the compression element and the base.

19 Claims, 3 Drawing Sheets

HEATER APPARATUS, CIRCUIT INTERRUPTER, AND RELATED METHOD

BACKGROUND

Field

The disclosed and claimed concept relates generally to circuit interrupters and, more particularly, to a heater apparatus for use in a thermal trip of a circuit interrupter.

Related Art

Circuit interrupters are known for use in many applications. Circuit interrupters such as circuit breakers and other devices are typically employed to protect a portion of a circuit during certain predefined overcurrent conditions, under-voltage conditions, and other conditions.

Such circuit interrupters typically include one or more trip devices such as a magnetic trip, a thermal trip, etc., each of which is typically connected with an operating mechanism that is configured to move the circuit interrupter between an ON condition and a TRIPPED or an OFF condition when one or more of the predetermined conditions in the protected circuit are met. A magnetic trip typically involves some type of an armature which moves rapidly in response to magnetic fields that are developed within the circuit interrupter in the presence of a rapid current increase. A thermal trip typically includes a bimetal strip which deflects as a result of $I^2R$ heating of the bimetal strip in response to sustained current flow through the circuit interrupter.

While such trip devices have been generally effective for their intended purposes, they have not been without limitation. For example, in relatively low current applications, such as 20 Amperes or less, the $I^2R$ heat in the bimetal strip may typically be insufficient to provide a sufficiently prompt response to a sustained overcurrent condition. The thermal trip in such an application may be supplemented by a heater which is in the form of an electrical conductor that is electrically and thermally connected with the bimetal strip and which generates some additional $I^2R$ heat as a result of current flow through the circuit interrupter. Such additional $I^2R$ heat is thermally conducted to the bimetal strip in order to supplement its own $I^2R$ heat and thus enhances the deflection of the bimetal strip at a given current level. However, the addition of such a heater to the thermal trip within the interior of a circuit interrupter adds thermal, magnetic, and mechanical complexity to the circuit interrupter, and it thus would be desirable to provide a solution that meets certain shortcomings known in the relevant art.

SUMMARY OF THE INVENTION

An improved heater apparatus is structured for use in a circuit interrupter having a thermal trip and includes a conductive device having a terminal and a heater that are co-formed with one another. The terminal includes a base and a support. The conductive device is formed from an individual metallic plate that is bent to form a number of plate elements. The base includes at least one plate element, and the heater includes at least another plate element, with the base and the heater being co-formed. A compression element is threadably receivable on the terminal and is structured to compressively retain an electrical conductor between the compression element and the base.

Accordingly, an aspect of the disclosed and claimed concept is to provide such an improved heater apparatus.

Another aspect of the disclosed and claimed concept is to provide an improved circuit interrupter that includes such an improved heater apparatus.

Another aspect of the disclosed and claimed concept is to provide an improved method of forming a heater apparatus that includes bending an individual metallic plate to form a conductive device having a number of plate elements that are co-formed with one another, with at least one plate element being a base of a terminal, and with at least another plate element being a heater, the base and the heater being co-formed.

Accordingly, an aspect of the disclosed and claimed concept is to provide an improved heater apparatus structured for use in a circuit interrupter having a thermal trip. The heater apparatus can be generally stated as including a conductive device and a compression element situated on the conductive device. The conductive device can be generally stated as including a terminal and a heater co-formed with one another. The terminal can be generally stated as including a base and a support, the support extending from the base. The compression element is disposed on the support and is structured to be movable toward and away from the base and is further structured to compressively retain an electrical conductor between the compression element and the base. The heater is structured to be thermally conductively connected with at least a portion of the thermal trip. The heater is further structured to conduct electricity within the circuit interrupter and to generate resistance heat which is communicated at least in part to the thermal trip

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
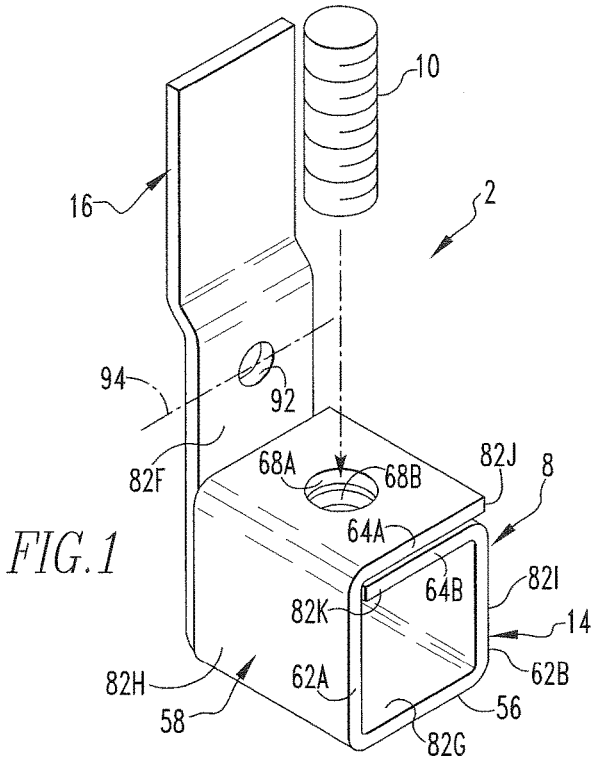
FIG. 1 is an exploded perspective view of an improved heater apparatus in accordance with a first embodiment of the disclosed and claimed concept.
Figure 2:
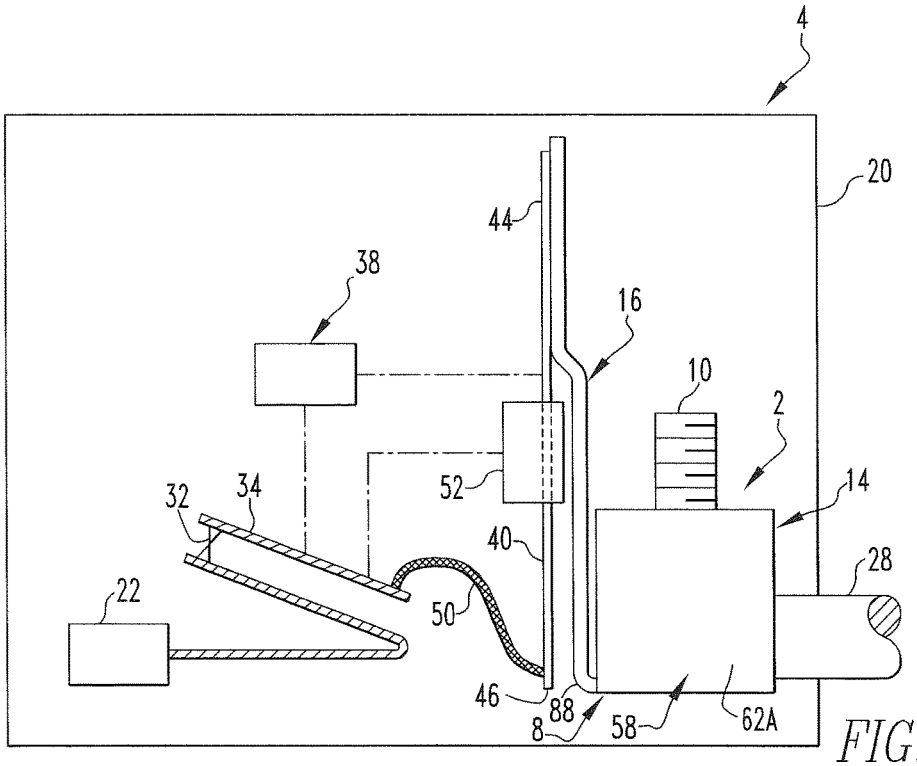
FIG. 2 is a schematic depiction of an improved circuit interrupter in accordance with the disclosed and claimed concept that includes the heater apparatus of FIG. 1.
Figure 3:
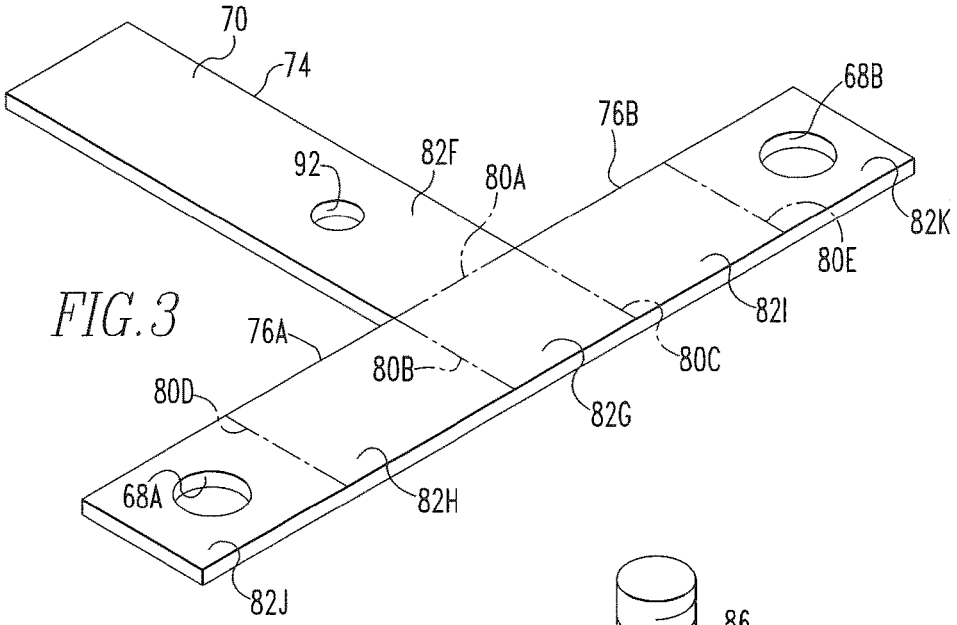
FIG. 3 is a perspective view of an individual metallic plate from which a conductive device of the heater apparatus of FIG. 1 is formed.
Figure 4:
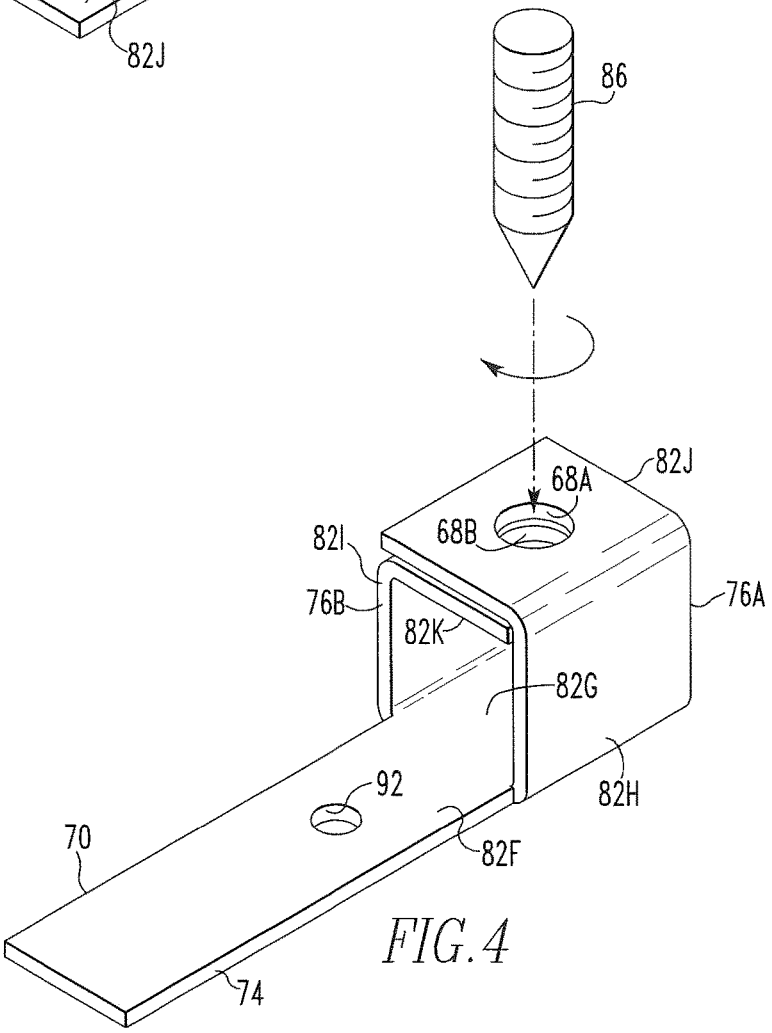
FIG. 4 is a view similar to FIG. 3, except depicting the individual metallic plate partially formed into the conductive device.

An improved heater apparatus 2 in accordance with the disclosed and claimed concept is depicted in FIGS. 1 and 2 and is depicted in part in FIGS. 3 and 4. The improved heater apparatus 2 can advantageously be employed as is depicted schematically in FIG. 2 in an improved circuit interrupter 4 in accordance with the disclosed and claimed concept.

The heater apparatus 2 can be said to include a conductive device 8 and a compression element 10 which, in the depicted exemplary embodiments, is a conventional threaded set screw that cooperates threadably with the conductive device 8, as will be set forth in greater detail below. The conductive device 8 can be said to include a terminal 14 and a heater 16 that are co-formed with one another. As employed herein, the expression co-formed and variations thereof refers broadly to any type of formation or connection methodology which enables the terminal 14 and the heater 16 to remain connected together without the use of additional structures that rely upon the application of compressive forces to either or both of the terminal 14 and the heater 16 in order to maintain their connection, and thus would encompass formation out of an individual piece of material such as through bending of a piece of material or formation of a piece of material such as via casting, and could also encompass welding, brazing, soldering, and other such connection techniques, as well as other formation methodologies. As will be set forth in greater detail below, the conductive device 8 is formed from an individual and generally T-shaped metallic plate 70, as is indicated generally in FIG. 3, which is formed from a plate-like piece of mild steel, by way of example, and which is formed via bending and other formation methodologies to result in the conductive device 8. The formation methodologies described herein to provide the conductive device 8 with its terminal 14 and heater 16 being co-formed with one another are merely exemplary in nature, and it is understood that other formation methodologies that will result in such co-forming of the terminal 14 and the heater 16 will be apparent to one of ordinary skill in relevant art based upon the teachings presented herein.

As can be seen in FIG. 2, the schematically-depicted circuit interrupter 4 in which the heater apparatus 2 can be employed includes a housing 20. Upon the housing 20 are disposed a line terminal 22 and the heater apparatus 2 whose terminal 14 in combination with the compression element 10 serves as a load terminal for the circuit interrupter 4. The terminal 14 is connectable with an electrical conductor 28 such as may be connected with an electrical load, by way of example. It is understood, however, that such components of the heater apparatus 2 may alternatively serve as the line terminal 22 without departing from the present concept.

As can further be seen in FIG. 2, the circuit interrupter 2 additionally includes a set of separable contacts 32 and further includes a moving contact arm 34 upon which one contact of the set of separable contacts 32 is situated. An operating mechanism that is not expressly depicted herein moves the movable contact arm 34 between its ON condition depicted generally in FIG. 2 and an OFF or a TRIPPED condition that is not expressly depicted herein wherein the set of separable contacts 32 are electrically separated from one another.

The circuit interrupter 4 additionally includes a thermal trip 38 having a bimetal 40, one end of which can be considered to be a fixed end 44 that is affixed via spot welding or other methodology to the end of the heater 16 opposite the terminal 14 and further includes a free end 46 opposite thereto. A woven shunt 50 is connected between the free end 44 of the bimetal 40 and the moving contact arm 34 via brazing or other appropriate connection methodology. For the sake of completeness, it is noted that the circuit interrupter 4 additionally includes a magnetic trip 52 that includes a generally U-shaped metallic core that is affixed to the heater 16 via spot welding or other appropriate connection methodology. The operation of the circuit interrupter 4 will be set forth below.

As can be seen in FIG. 1, the terminal 14 can be said to include a base 56 and a support 58, with the support 58 extending away from the base 56. The support 58 can be said to include a pair of lugs 62A and 62B and a pair of backing plates 64A and 64B. The lugs 62A and 62B are, in the depicted exemplary embodiment, parallel and spaced apart and carry the backing plates 64A and 64B, respectively, at positions that are spaced apart from the base 56. The backing plates 64A and 64B have a pair of holes 68A and 68B (see FIG. 3) formed therein which, after formation of the conductive device 8 has been completed, are aligned with one another and are threadably cooperable with the compression element 10.

As can be understood from FIGS. 3 and 4, and as suggested above, the conductive device 8 is formed out of the individual metallic plate 70 that is generally T-shaped prior to the formation operations that form the metallic plate 70 into the conductive device 8. The plate 70 can be said to include an elongated body 74 and a pair of wings 76A and 76B that protrude at one end of the body 74 in opposite directions away from the body 74. Also depicted in FIG. 3 are a set of bend locations indicated at the numerals 80A, 80B, 80C, 80D, and 80E (collective referred to hereinafter at the numeral 80) wherein bends are formed in the plate 70 in order to form the conductive device 8 out of the metallic plate 70. More particularly, by forming bends in the plate 70 at the bend locations 80, the plate 70 is formed into a number of plate elements 82F, 82G, 82H, 82I, 82J, and 82K (collective referred to hereinafter at the numeral 82). As employed herein, the expression "a number of" and variations thereof shall refer broadly to any non-zero quantity, including a quantity of one.

As can be understood from FIGS. 3 and 4, the plate element 82F is the heater 16 in the conductive device 8, and the plate element 82G is the base 56 in the conductive device 8. Moreover, the plate elements 82H and 82I are the lugs 62A and 62B, respectively, and the plate elements 82J and 82K are the backing plates 64A and 64B, respectively, of the conductive device 8. As can be understood from FIG. 3, the plate 70 may be configured to have the holes 68A and 68B already formed therein prior to any bending of the plate 70 or at any appropriate time during the formation methodology of the conductive device 8. When bends are formed at the bend locations 80B, 80C, 80D, and 80E, the plate 70 appears as is depicted generally in FIG. 4, and the holes 68A and 68B are aligned with one another. The holes 68A and 68B can then be threaded via the use of a threaded tap 86 as is known in the relevant art, although other thread formation methodologies can be performed without departing from the present concept. It is noted, however, that by employing the tap 86 subsequent to the bending operations that cause the holes 68A and 68B to become aligned with one another, a single application of the tap 86 can cause the holes 68A and 68B to be commonly threaded, meaning that the compression element 10 can be easily threadably received in both the holes 68A and 68B. Threading of the compression element 10 in the holes 68A and 68B enables the compression element 10 to compressively retain the electrical conductor 28 (FIG. 2) between the compression element 10 and the base 56. In this regard, it is understood that the compression element 10 is threadably movable on the support 56 and, more particularly, on the backing plates 64A and 64B toward and away from the base 56, which enables the compression element 10 compressive retain the electrical conductor 28 on the terminal 14.

A bend 88 is also formed in the plate 70 at the bend location 80A, such that the bend 88 is formed between the base 56 and the heater 16. It is nevertheless reiterated that despite the bend 88 between the heater 16 and the base 56, the heater 16 and the base 56 are co-formed by virtue of their formation out of the individual metallic plate 70 and the bend 88 applied at the bend location 80A.

By causing the heater 16 and the base 56 to be co-formed as set forth above, the electrical connection between the heater 16 and the terminal 14 is highly reliable, and the electrical resistance properties of the heater apparatus 2 between the base 56 and the free end of the heater 16 opposite the base 56 are highly predictable. In order to cause the heater 16 to generate a predetermined amount of $I^2R$ heat during operation of the circuit interrupter 4 when current flows through the heater 16, the heater 16 can be configured to include a cut region 92 (FIGS. 1, 3, and 4) which, in the first embodiment, is in the exemplary form of a round hole 92 formed generally centrally in the heater 16 between the opposite sides thereof. The cross-sectional dimension of the heater 16 at the cut region 92, as is indicated with a line 94 in FIG. 1, and which is transverse to a direction of current flow through the heater 16, it is a smaller cross-sectional dimension than a corresponding cross-sectional dimension of the heater 16 adjacent thereto but that does not extend across the cut region 92. As such, the heater 16 at the cut region has a relatively higher resistance than other portions of the heater 16, with the result that a relatively greater amount of $I^2R$ heat will be generated in the vicinity of the cut region 92 than elsewhere in the heater 16. Much of the $I^2R$ heat generated in the heater 16 is thermally conducted through the heater 16 to the bimetal 40 for purposes mentioned elsewhere herein.

Advantageously, since the heater 16 and the base 56 are co-formed with one another, the electrical resistance characteristics of the connection between the heater 16 and the base 56, i.e., the bend 88, are highly predictable. The electrical resistance characteristics of the heater 16 between the base 56 and its free end are similarly highly predictable, and the cut region 92 can be formed in the heater 16 with a likewise highly predictable resistance result. Such predictability advantageously avoids the need for individual calibration of each such heater apparatus 2, which reduces cost.

In use, $I^2R$ heat generated at the cut region 92 and elsewhere in the heater 16 is thermally communicated to the bimetal 40, and such communicated $I^2R$ heat enhances deflection of the bimetal 40 in response to prolonged current flowing through the circuit interrupter 4. Once the deflection of the bimetal 40 reaches a predetermined amount, the thermal trip 38 causes the operating mechanism to move the moving contact arm 34 from its ON condition depicted schematically in FIG. 2 to an OFF or a TRIPPED condition of the circuit interrupter 4 that are not expressly depicted herein.

Figure 5:
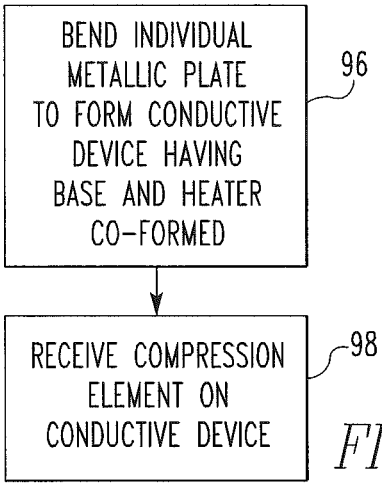
FIG. 5 is a flowchart depicting certain aspects of an improved method in accordance with the disclosed and claimed concept.

While numerous formation methodologies can be employed to form the heater apparatus 2 depicted generally in FIG. 1, an exemplary method in accordance with the disclosed and claimed concept that is described herein is depicted generally in FIG. 5. The method includes bending an individual metallic plate 70 to form a conductive device 8 having a base 56 and a heater 16 that are co-formed with one another, as at the numeral 96 in FIG. 5. The holes 68A and 68B are formed in the backing plates 64A and 64B and may be threaded, as with the tap 86, to enable the holes 68A and 68B to be threadably cooperable with the compression element 10. The compression element 10 is then received, as at 98, on the conductive device 8 and is compressively engageable with the electrical conductor 28 to connect the circuit interrupter 4 and the heater apparatus 2 to, for instance, an electrical load.

Figure 6:
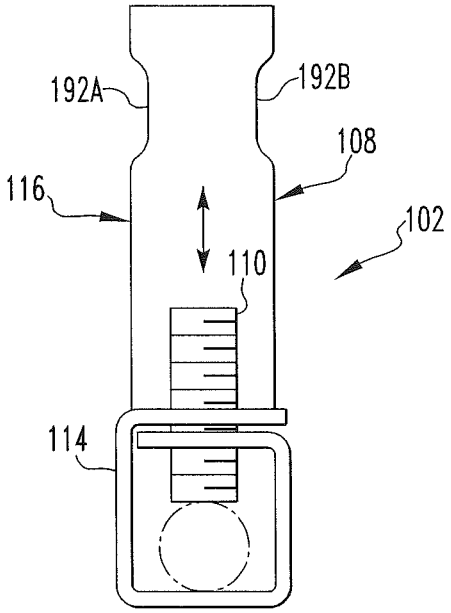
FIG. 6 is a front elevational view of an improved heater apparatus in accordance with a second embodiment of the disclosed and claimed concept.

A heater apparatus 102 in accordance with a second embodiment of the disclosed and claimed concept is depicted generally in FIG. 6. The heater apparatus 102 is similar to the heater apparatus 2 in that it includes a conductive device 108 and a compression element 110, with the conductive device 108 including a heater 116 that is co-formed with a terminal 114 thereof.

As is understood from FIG. 6, however, the heater 116 employs as a cut region a pair of holes in the form of side cuts 192A and 192B formed in the sides of the heater 116, rather than employing a hole as at the cut region 92 that is spaced from both sides. It is understood that the hourglass-type holes, i.e., side cuts, can be of other shapes without departing from the present concept, and they need not be aligned with one another. Moreover, the cut region can be limited to a cut in only side of the heater 116 without departing from the present concept. It thus can be understood that virtually any type of cut, or even no cut at all depending upon the circumstances of the individual application, can be employed to provide the needed $I^2R$ heating characteristics to the heater 116 or the heater 16, or other such heaters as the case may be.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A method of forming a heater apparatus for use in a circuit interrupter having a thermal trip, the method comprising:

bending an individual metallic plate to form a conductive device having a number of plate elements wherein:

at least one plate element of the number of plate elements is a base of the conductive device, at least another plate element of the number of plate elements is a heater of the conductive device, the heater being thermally conductively connected with at least a portion of the thermal trip, the heater being structured to conduct electricity within the circuit interrupter and to generate resistance heat which is communicated at least in part to the thermal trip, and at least a further plate element of the number of plate elements is a support of the conductive device, the support extending from the base;

receiving on the support a compression element that is movable toward and away from the base and to compressively retain an electrical conductor between the compression element and the base; and employing as the plate an individual and generally T-shaped plate-like conductive element having an elongated body and a pair of wings situated at an end of the body, the wings extending in opposite directions away from the end of the body.

2. The method of claim 1, further comprising forming threading on a pair of holes formed in the pair of wings.

3. The method of claim 2, further comprising deforming the wings to align the holes with one another, and performing the forming of threading subsequent to the deforming.

4. The method of claim 3, further comprising threadably receiving the compression element in the holes.

5. The method of claim 3, further comprising as a part of the deforming of the wings, causing a portion of a wing of the pair of wings having formed therein a hole of the pair of holes to overlie a portion of another wing of the pair of wings having formed therein another hole of the pair of holes.

6. The method of claim 5, further comprising as a part of the deforming of the wings, causing another portion of the wing to form a lug, and causing another portion of the another wing to form another lug, the lug and the another lug spacing away from the base the overlying portions of the wing and the another wing.

7. The method of claim 1, further comprising forming a bend between the base and the heater.

8. The method of claim 1, further comprising employing as the plate an individual plate-like conductive element having an elongated body and at least a first wing, the at least first wing being situated on the body and extending away from the body.

9. The method of claim 8 wherein the plate has at least a first hole formed therein, and further comprising forming threading on the at least first hole.

10. The method of claim 9, further comprising performing the forming of threading subsequent to at least a portion of the bending.

11. The method of claim 9, further comprising threadably receiving the compression element in the at least first hole.

12. The method of claim 9, further comprising as a part of the bending, causing a portion of the conductive element to form a lug that spaces the at least first hole away from the base.

13. The method of claim 8 wherein the plate has a pair of holes formed therein, and further comprising forming threading on at least a first hole of the pair of holes.

14. The method of claim 13, further comprising deforming the conductive element to align the holes of the pair of holes with one another.

15. The method of claim 14, further comprising performing the forming of threading subsequent to at least a portion of the deforming.

16. The method of claim 14 wherein the forming of threading comprises forming threading on both holes of the pair of holes.

17. The method of claim 16, further comprising threadably receiving the compression element in the pair of holes.

18. The method of claim 14 wherein the deforming comprises overlying a portion of the conductive element with another portion of the conductive element.

19. The method of claim 18, further comprising as a part of the deforming, forming in the conductive element a pair of lugs that space the pair of holes away from the base.

* * * * *